US005105553A

United States Patent [19]

Weston

[11] Patent Number: 5,105,553

[45] Date of Patent: Apr. 21, 1992

[54] TIE GAUGE FOR TYING A CONSTANT LENGTH

[76] Inventor: Thomas E. Weston, 1324 Surf Side La., St. Clair, Mo. 63077

[21] Appl. No.: 612,786

[22] Filed: Nov. 14, 1990

[51] Int. Cl.[5] ..... G01B 3/30

[52] U.S. Cl. ..... 33/613; 2/146

[58] Field of Search ..... 33/613; 2/144, 145, 2/146

[56] References Cited

U.S. PATENT DOCUMENTS

| | | | |
|---|---|---|---|
| 2,148,154 | 2/1939 | Garfinkle . | |
| 2,343,979 | 3/1944 | Kaplan . | |
| 2,499,260 | 2/1950 | Rhein . | |
| 2,504,843 | 4/1950 | Kaplan . | |
| 2,994,886 | 8/1961 | Sharp . | |
| 3,271,780 | 9/1966 | De Jean | 2/146 |
| 3,321,773 | 5/1967 | Orciuch | 2/146 |
| 3,490,073 | 1/1970 | Webster | 2/146 |
| 3,747,220 | 7/1973 | Weisnicht | 2/146 X |
| 3,797,044 | 3/1974 | Chow . | |
| 4,564,958 | 1/1986 | Woodward . | |

FOREIGN PATENT DOCUMENTS

| | | | |
|---|---|---|---|
| 3801864 | 8/1989 | Fed. Rep. of Germany | 2/144 |
| 2099681 | 12/1982 | United Kingdom | 2/144 |

*Primary Examiner*—Harry N. Haroian

*Attorney, Agent, or Firm*—Robbins & Robbins

[57] ABSTRACT

A tie gauge for tieing a four-in-hand tie to position the wide end at a selected portion of the waist such as the belt buckle is provided. The tie gauge is comprised of selected characterized markings such as numbers on a strip of fabric attached to the inside of the tie. The strip is positioned a pre-selected fixed distance from a bottom or lower end of the wide end of the tie and is of sufficient length that the user may register a selected marking that may be used to tie the tie with the wide end appearing at the desired length. The selected marking in the initial tieing stage of crossing the wide end over the narrow end is registered with a standard point in the narrow end such as the center of the cross-over position.

9 Claims, 1 Drawing Sheet

TIE GAUGE FOR TYING A CONSTANT LENGTH

BACKGROUND OF THE INVENTION

In the past there have been provided various types of tie gauges for four-in-hand ties to position the wide end and narrow end at the same or varying positions with one another. These gauges have generally been strips or markings provided on the interior or back of the tie which are hidden when the tie is sewn.

While such gauges have been provided there has not been established a gauge which can be inserted in read to wear stock ties as sold in retail stores and can be employed for users of different sizes and build to tie a four-in-hand knot to position the wide end at a consistent position in relation to the waist. For the fashion conscious and appearance in the business world, a consistent or standard length is important.

SUMMARY OF THE INVENTION

By means of this invention, there has been provided a tie gauge for use with conventional four-in-hand ties of varying length which can be simply employed to tie the tie in such a manner that the wide end will appear in the tie when tied at the desired standard position in regard to the waist.

The tie gauge is comprised of a series of spaced selected graduated characterized markings on the inside of the tie. The markings may be in the form of a strip or printed marking and may be graduated as in inch, half inch markings and the like as in a ruler. The gauge is of sufficient length that it may be employed by users of different size to provide a consistent length of the wide end when tied.

The gauge may be employed on different lengths of ties by positioning it on the inside of the tie at a uniform distance from the bottom of the wide end of the tie. In this manner the user need not be concerned with the length of the tie in the tieing operation.

The gauge is employed by positioning a selected gauge marking of the wide end of the tie in proper registry with a standard point such as the center of the narrow end of the tie in the initial cross-over of the wide end upon the narrow end of the tie in the tieing operation. The selected marking is first chosen by trial and error and once selected is employed for all ties regardless of variance in total length.

The gauge provides a convenient, efficient, low cost and consistent means for tieing a tie in a standard fashion. It may be employed in ready to wear ties as sold or may be added by the user as desired.

IN THE DRAWING

DESCRIPTION OF THE INVENTION

Figure 1:
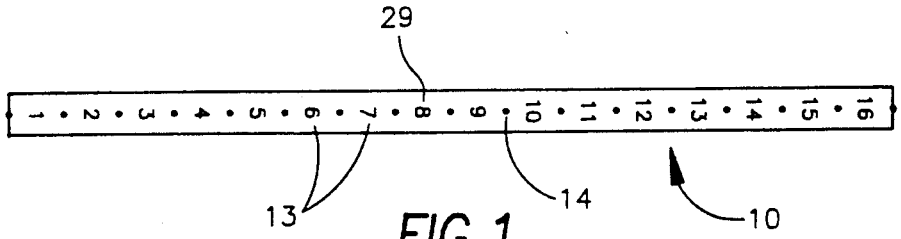
FIG. 1 is a plan view of the inside of a tie provided with the tie gauge.

The tie gauge of this invention has been developed for use with conventional four-in-hand ties to provide a standard positioning when tied of the wide end with respect to the belt buckle. The gauge may be employed with ties of different length and varied materials of construction. The tie knot employed may be of different types such as the full Windsor, half Windsor and four-in-hand. By use of the tie gauge the tie may be tied in such a manner that the wide end when the tie is tied with the same type of knot, always come out at the same position. In a preferred tieing operation the end of the wide tie is at the top of the belt buckle in accordance with present fashion.

The tie gauge is generally indicated by the reference numeral 10 in FIGS. 1, 2, 3 and 4. It is shown stitched to the inside portion of a standard four-in-hand tie 12 in FIGS. 2, 3 and 4.

Figure 2:
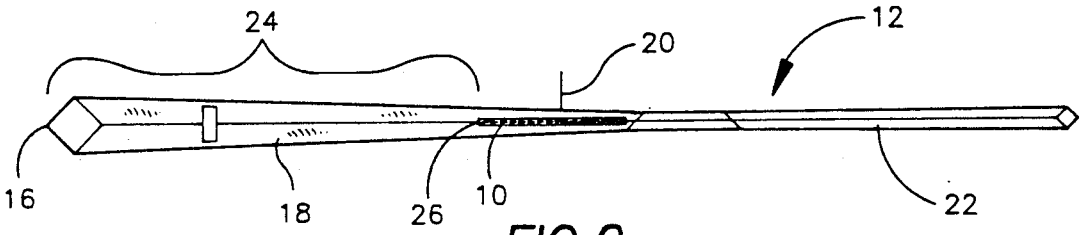
FIG. 2 is an enlarged plan view of the tie gauge.

As shown in FIGS. 1 and 2, the tie gauge may be in the form of a flexible strip of cloth or the like sewn or otherwise secured to the inside of the tie. The gauge is provided with spaced markings 13 such as the numbers 1 through 16 every half inch with dot markings 14 between the numbers, one-quarter inch from opposing numbers. It will be understood that other distinctive markings such as letters or the like may be employed to provide a reference point, as will be further described, in tieing the tie to achieve a standard tied length of the wide end. It will also be understood that instead of a strip the tie gauge markings may be printed on the inside of the tie, embossed by stitching or otherwise applied.

In order to provide standardization in the use of the tie the gauge is applied to the tie a fixed distance from the end 16 of the wide end 18 of the tie. The gauge is applied in the general region of the neck band in such a manner that it may extend beyond a mid point 20 of the tie toward the wide end 18 and the narrow end 22 of the tie.

By applying the tie gauge a fixed distance on the various ties used by the user, it may be assured that then using the same type of knot, the user may register a reference marking 13 such as the number 8 on the gauge with a target point on the narrow end of the tie in the tieing operation to achieve a standard length and position of the tied wide end of the tie. This selection of the proper reference mark may be obtained by the use regardless of his height, neck size or other size of the upper body structure. It will be understood that users of different physical sizes will employ reference markings as suitable.

The fixed distance is best shown in FIG. 2 by the reference numeral 24 which is the distance between the end 16 of the wide end of the tie and the lower end 26 of the tie gauge. When the tie gauge 10 is applied to different ties even though of different length, the affixation of the tie gauge this same fixed or standard distance 24 enables the user to tie the tie in such a manner that the end 16 uniformly is positioned in the same manner with respect to the belt buckle. It will be understood of course, that where different lengths of ties are employed, the narrow end of the tied tie will vary in length.

For ties that are thicker than a standard tie, such as for knitted ties or the like, a little longer length of the tie may be required to tie the knot and conversely, a little less length of tie may be required for some silk ties. A difference of ¼ to ½ inches may be involved. As a way of accommodating different thicknesses and/or construction of the tie, the user of the manufacturer may vary the distance of the bottom end of the gauge from the bottom of the wide end of the tie to position the gauge in such a manner that the gauge number will produce a tie in which the bottom of the wide end of the tie appears in the same position relative to the belt buckle.

Figure 3:
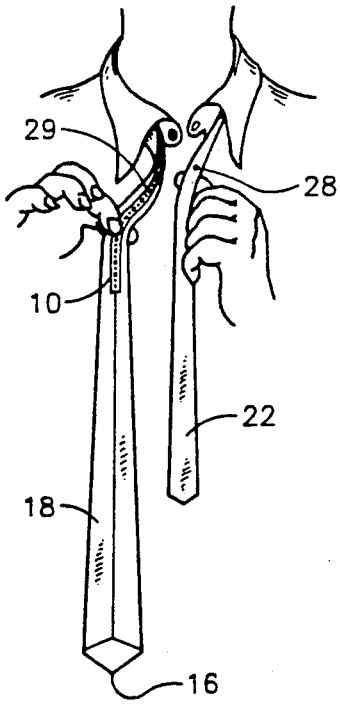
FIG. 3 is a pictorial view showing the initial tieing stage.
Figure 4:
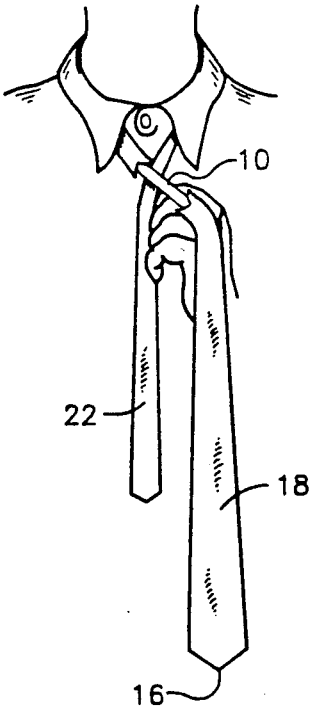
FIG. 4 is a pictorial view partly broken away showing the back of the wide end of the tie registering with a center portion of the narrow end of the tie in a further tieing stage.
Figure 5:
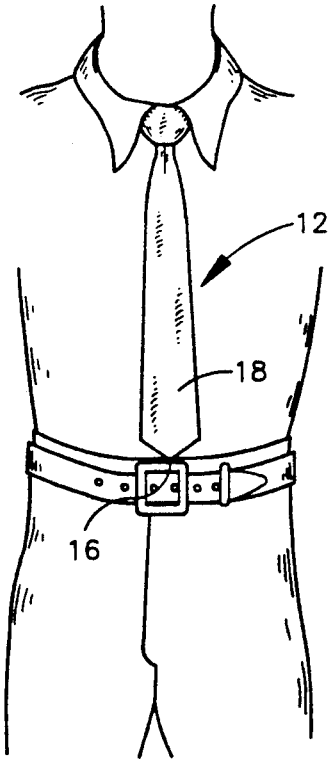
FIG. 5 is a view in elevation showing the finished tie.

The tieing operation is best shown in FIGS. 3, 4 and 5. FIGS. 3 and 4 show the usual cross-over operation where the user crosses the wide end 18 over the narrow end 22. In this operation, which may be by trial and error, the user registers a number such as 8 as shown by the reference numeral 29 on the tie gauge with the center unmarked portion 28 of the narrow end of the tie and carries out the tieing operation in the usual consistent manner. If the tied tie is the desired length as shown, for example, in FIG. 5 the marking 8 is the number to be used for other ties having the gauge at the same distance 24 from the wide end. If the tie is too long, the wide end is shortened in the tieing operation to use a gauge number such as 6 until the proper length is obtained. Conversely, should the tie be too short, the tie is lengthened and a reference marking such as 10 may be employed. This adjustment is carried out until the proper length is achieved. The reference mark on the tie gauge used in the proper tie length is then used on other ties equipped with the tie gauge using the same type of knot. It will be understood that the same reference marking is employed for the same knot and that different types of knots may have different selected reference marks all of which are obtained in the aforesaid manner.

EXAMPLE

For the purpose of example only, a tie may be employed that is 56 inches long which is a common length. The gauge 10 with marking numbers 1 through 16 spaced one-half inch apart is eight inches long and the lower end 26 is spaced twenty-two inches from the end 16 of the wide end of the tie. The gauge extends across the middle or neck band portion of the tie with a major portion of six inches extending beyond the mid point or bight 20 of the tie toward the wide end and a minor two inch portion of the gauge extending beyond the tie mid point toward the narrow end. These dimensions are used for purpose of example only and it will be understood that the gauge may be longer or somewhat shorter as long as it extends far enough to provide a reference point to register with the middle or some other fixed target of the narrow end of the tie in the cross over position of tieing the tie as shown in FIGS. 3 and 4.

Various changes and modifications may be made within this invention as will be apparent to those skilled in the art. Such changes and modifications are within the scope and teaching of this invention as defined in the claims appended hereto.

What is claimed is:

1. A tie gauge for ties which may be of varying lengths, said gauge comprising spaced graduated characterized markings on the inside of the ties extending a length from approximately the middle of the ties toward the wide end of the ties a sufficient distance to provide for registry of a selected marking on the gauge with a center of the narrow end when the wide end is crossed over said narrow end in an initial stage of tieing the ties to position the wide end at a consistent point in relation to the waist of the user, a bottom end of said tie gauge being a pre-selected fixed distance from a bottom end of said wide end of the ties.

2. The tie gauge of claim 1 in which the tie gauge is a fabric strip affixed to the inside of the tie.

3. The tie gauge of claim 1 in which said markings extend for a minor portion of said length from the middle of said tie toward the narrow end and a major portion of said length toward said wide end.

4. The tie gauge of claim 2 in which said selected marking provides a sufficient length of the wide end of said tie to position the wide end at the top of a belt buckle of the user.

5. The tie gauge of claim 3 in which said markings extend for a minor portion of said length from the middle of said tie toward the narrow end and a major portion of said length toward said wide end and said selected provides a sufficient length of the wide end of said tie to position the wide end at the top of a belt buckle of the user when tied.

6. The tie gauge of claim 1 in which said pre-selected fixed distance is slightly greater for ties thicker than a standard tie and slightly less for ties thinner than said standard tie to accommodate for different lengths of material in the wide end employed in tieing a knot portion of the tied tie and whereby the selected making may be registered with said center to position the wide end at said consistent point in relation to the waist of the user.

7. A method for tieing ties which may be of varying lengths in such a manner that an end of a wide end of a four-in-hand tie is positioned at a uniform position with respect to the waist of the suer, said method comprising employing a tie gauge for four-in-hand ties, said gauge comprising spaced graduated characterized markings on the inside of the ties toward the wide end of the ties a sufficient distance to provide for registry of a selected marking with a center of the narrow end when the wide are crossed over said narrow end in an initial stage of tieing the ties to position the wide end at a consistent point in relation to the waist of the user, a bottom end of said tie gauge being a pre-selected fixed distance from a bottom end of said wide end of the ties, said ties being tied by comprising the wide end of the ties over the narrow end and registering the selected marking with the center on the narrow end and completing the tieing operation.

8. The method of claim 7 in which the selected marking is selected by trial and error and once selected is used on ties having the aforesaid gauge to achieve a unfirm length of the wide end of the tied tie.

9. The method of claim 7 in which a characterized marking is employed further from the end of the wide end of the tie for thicker ties than standard thickness and closer to the wide end of the tie for thinner ties than standard thickness whereby the selected making may be registered with said center to position the wide end at said consistent point in relation to the waist of the user.

* * * * *